US005892493A

United States Patent [19]

Enami et al.

[11] Patent Number: 5,892,493

[45] Date of Patent: Apr. 6, 1999

[54] DATA LINE PRECHARGING APPARATUS AND METHOD FOR A LIQUID CRYSTAL DISPLAY

[75] Inventors: Kunio Enami; Takatoshi Tomooka, both of Shiga-ken, Japan

[73] Assignee: International Business Machines Corporation, Armonk, N.Y.

[21] Appl. No.: 683,738

[22] Filed: Jul. 17, 1996

[30] Foreign Application Priority Data

Jul. 18, 1995 [JP] Japan ..... 7-181389

[51] Int. Cl.[6] ..... G09G 3/36

[52] U.S. Cl. ..... 345/94; 345/100; 349/37

[58] Field of Search ..... 345/90, 94, 96, 345/58, 92, 98–100, 211–213; 349/37

[56] References Cited

U.S. PATENT DOCUMENTS 5,151,689 9/1992 Kabuto et al. ..... 345/94 X
5,398,043 3/1995 Takeda et al. ..... 345/94
5,426,447 6/1995 Lee ..... 345/94 X
5,686,936 11/1997 Maekawa et al. ..... 345/100
5,708,454 1/1998 Katoh et al. ..... 345/100

*Primary Examiner*—Steven J. Saras
*Assistant Examiner*—Seth D. Vail
*Attorney, Agent, or Firm*—Ronald L. Drumheller

[57] ABSTRACT

The quality of an image is improved even if the duration of data voltage is short for application. A gate line driver 34 sequentially applies the gate voltage to a number of gate lines G1–Gm by predetermined duration. Data lines are grouped into four groups each consisting of n lines (d1A–dnA: group A, d1B–dnB: group B, d1C–dnC: group C, and d1D–dnD: group D). A data line driver 40 and a multiplexer 38 sequentially perform for the data line groups A–D in the above predetermined duration application of data voltage to each data line in a predetermined data line group. A precharge controller 44 and a voltage switching circuit 46 apply to each of the data line groups A–D, through a transistor 42, a precharge voltage ($+V_1$ or $-V_1$) with the same polarity with that of data voltage being applied next time during the time from previous application of the data voltage to next application of it.

13 Claims, 10 Drawing Sheets

FRAME n

| | | | | |
|---|---|---|---|---|
| + | + | + | + | + |
| + | + | + | + | + |
| + | + | + | + | + |
| + | + | + | + | + |
| + | + | + | + | + |

FRAME n + 1

| | | | | |
|---|---|---|---|---|
| − | − | − | − | − |
| − | − | − | − | − |
| − | − | − | − | − |
| − | − | − | − | − |
| − | − | − | − | − |

FIG. 4A

FRAME n

| | | | | |
|---|---|---|---|---|
| + | + | + | + | + |
| − | − | − | − | − |
| + | + | + | + | + |
| − | − | − | − | − |
| + | + | + | + | + |

FRAME n + 1

| | | | | |
|---|---|---|---|---|
| − | − | − | − | − |
| + | + | + | + | + |
| − | − | − | − | − |
| + | + | + | + | + |
| − | − | − | − | − |

FIG. 4B

FRAME n

| | | | | |
|---|---|---|---|---|
| + | − | + | − | + |
| − | + | − | + | − |
| + | − | + | − | + |
| − | + | − | + | − |
| + | − | + | − | + |

FRAME n + 1

| | | | | |
|---|---|---|---|---|
| − | + | − | + | − |
| + | − | + | − | + |
| − | + | − | + | − |
| + | − | + | − | + |
| − | + | − | + | − |

FIG. 4C

FRAME n

| | | | | |
|---|---|---|---|---|
| + | − | + | − | + |
| + | − | + | − | + |
| + | − | + | − | + |
| + | − | + | − | + |
| + | − | + | − | + |

FRAME n + 1

| | | | | |
|---|---|---|---|---|
| − | + | − | + | − |
| − | + | − | + | − |
| − | + | − | + | − |
| − | + | − | + | − |
| − | + | − | + | − |

FIG. 4D

DATA LINE PRECHARGING APPARATUS AND METHOD FOR A LIQUID CRYSTAL DISPLAY

BACKGROUND OF THE INVENTION

1. Field of the Invention

The present invention relates to a device and method for driving a liquid crystal display, and, more particularly, to a method for driving a liquid crystal display having display cells each of which consists of a switching element connected to a data line and a gate line, a pair of electrodes oppositely disposed with a predetermined spacing, and a liquid crystal disposed between the pair of electrodes, and a driver for a liquid crystal display to which the driving method can be applied.

2. Related Art

A liquid crystal display (LCD) is conventionally known as a display for displaying characters or images such as graphics on an information processing device such as a personal computer. An active matrix driven LCD which is composed by arranging switching elements such as thin film transistors (TFT) in a matrix is particularly promising as a display replacing a CRT because it can surely control intensity of pixels and is also suitable for display of dynamic images with fast movement and color images. In a TFT LCD, a number of display cells are arranged in a matrix. Each display cell comprises a pair of TFT and an electrode provided on one of a pair of opposed substrates, a transparent common electrode formed over the entire surface of another substrate (transparent substrate), and liquid crystal sealed between the pair of substrates. The former substrate is provided with a number of gate lines for turning on the TFTs by row, and a number of data lines for applying voltage on the liquid crystal through the TFTs turned on.

A driving device for TFT LCD applies a voltage to the gate lines for a predetermined duration as shown in FIG. 10(A) to sequentially turn on the TFT of each display cell, and applies on each data line a voltage with intensity corresponding to a gradation value to be displayed on a display cell for which the TFT is turned on (data voltage) (see FIG. 10(B)). When the TFT is turned on and a data voltage is applied to the data line, the liquid crystal of each display cell varies its light transmittance according to the intensity of the voltage, and accumulates charges between the pair of electrodes. After the TFT is turned off, the accumulated charges maintain the state where the light transmittance is varied (see FIG. 10(C)). This causes an image to be displayed on the LCD. In addition, the life of liquid crystal is shortened if voltage with the same polarity continues to be applied. The life of liquid crystal is extended by driving the liquid crystal in a manner so as to periodically reverse the polarity of data voltage. For example, every one line or one frame the data voltage applied to each display cell is reversed utilizing the fact that the light is transmittance of liquid crystals becomes equal even if the polarity differs as long as the absolute value of the applied voltage is the same.

As a driver (a part of the driving device) for driving the data line of LCD, it is common to use a driver which has driving circuits for applying data voltage to the data lines in the same number as the data lines. However, when a very large number of data lines (for example, 1,000 lines) are provided to attain an LCD with a large surface area and high definition, which is an important challenge in the development of LCD, there arises a problem that the driver becomes very expensive because a very large number of driving circuits are necessary (for example, four driver ICs having 250 output terminals (250 driving circuits) are necessary to be provided to drive 1,000 data lines). In addition, when the pitch of LCD display cells is reduced to attain high definition of the LCD, the pitch of data lines is reduced as well. For example, if it is reduced to about 15 microns, it physically becomes very difficult to mount the driver ICs.

As a technique to overcome the above problems, it has been proposed to perform so-called multiplex driving wherein a driver having driving circuits of 1/n (n being an integer) in the number of data lines is provided, and a multiplexer is provided for selectively connecting the driver to any one of n sets of data line groups so that the driver and multiplexer sequentially drives n sets of data line groups. In such multiplex driving, because the number of driving circuits can be less than that of data lines, it is possible to keep the cost of the driver low, and mounting of the driver ICs can be relatively easy even if the pitch of data lines is small. However, in such multiplex driving, if the display cycle for an image (cycles of vertical and horizontal synchronizing signals) is constant, the time interval when the data voltage is applied to each of data line group is shortened as the ratio n of the number of data lines to the number of driving circuits (called the "multiplex ratio n") becomes larger. For example, as shown in FIG. 10(D), when the data lines are divided into four data line groups of A–D, and the data voltage is sequentially applied to display cells connected to each data line group, the duration to apply the data voltage to each display cell becomes ¼ of the case where multiplex driving is not performed. This makes, as shown in FIG. 10(E), insufficient the duration to apply the data voltage (insufficient duration of application being represented by $t_1$), and the voltage between the electrodes fails to reach the predetermined value corresponding to the applied data voltage (insufficient voltage between the electrodes being represented by $V_1$) so that gradation provided by the light transmittance of liquid crystal of each display cell does not match the gradation to be displayed on each display cell, and thus the quality of the displayed image is deteriorated.

Therefore, in the conventional multiplex driving, it is common to provide a multiplex ratio of about 2 (the number of driving circuits being ½ of the number of data lines). This is because it is difficult to increase the multiplex ratio n in view of the reason described above.

The present invention is made in view of the above facts, and is intended to obtain a device and method for driving a liquid crystal display which can display an image at high quality even if the time to apply the data voltage is short.

SUMMARY OF THE INVENTION

To attain the above object, a device for driving a liquid crystal display according to the present invention is a driving device for driving a liquid crystal display in which a number of data lines and a number of gate lines are arranged to intersect with each other, and respective display cells are positioned at the intersections of the data and gate lines, the display cell consisting of a switching element connected to a data line and a gate line, a pair of electrodes oppositely positioned with a predetermined spacing, and liquid crystal disposed between the pair of electrodes, the driving device comprising gate line driving means connected to a number of the gate lines, and for applying a voltage to the gate lines to turn on for a predetermined duration the switching element of the display cell connected to the gate line, data line driving means connected to a number of the data lines, and for applying a data voltage to the data lines for the predetermined duration to change the voltage between the electrode pair of the display cell connected to the gate line to which the voltage is applied by the gate line driving means to a predetermined voltage, and potential control means for controlling potential on a number of the data lines so that, before the data voltage is applied by the data line driving means, the potential on the data line is close to the data voltage being applied.

In the above arrangement, the data voltage is applied to the data line by the data line driving means in a state where the voltage is applied to the gate line and the switching element of respective display cells connected to the gate line is turned on. As the data voltage is applied, a current flows through the data line so that the voltage between the electrode pair of the display cell to which the data line is connected and the switching element of which is turned on is changed to a predetermined voltage. Here, the time from starting of application of data voltage to change of voltage between the electrode pair to the predetermined voltage is affected by capacitance between the electrode pair and capacitance contained in the data line. In this case, generally, the capacitance of the data line has higher electrostatic capacity than that between the electrode pair, and is more influential.

Thus, the present invention controls potential on a number of data lines with the potential control means so that the potential on the data line closes to the data voltage being applied before the data voltage is applied to the data line. Then, when the data voltage is applied to each data line, at least each data line would have potential at a value close to the data voltage being applied next. Thus, the time is shortened from starting of application of the data voltage to the time when the voltage between the electrode pair of the display cell reaches the predetermined voltage.

Accordingly, even if the duration is short for the application of data voltage to each data line, the voltage between the electrode pair reaches the predetermined voltage corresponding to the magnitude of applied data voltage so that the light transmittance of the liquid crystal of each display cell can be caused to match that corresponding to the value of gradation to be displayed on each display cell. Thus, an image can be displayed with high quality even if the duration of application of data voltage is short.

In addition, the present invention is the above driving device, wherein a number of the data lines consists of a plurality of data line groups, and the data line driving means sequentially applies a data voltage to the data line in each data line group in the predetermined duration.

The above arrangement could perform multiplex driving in which the data voltage is sequentially applied to a number of data lines in each of data line groups. As described above, since, according to the present invention, an image can be displayed at high quality even if the duration of data voltage application is short, the image can be displayed at high quality even when the multiplex ratio is increased, that is, even when the number of data lines constituting each data line group is reduced, and the number of data line groups is increased (this shortens the duration of data voltage application). In addition, since the number of data lines constituting each data line group can be reduced, it is easily attained to increase the size and definition of a liquid crystal display.

Furthermore, more particularly, the potential control means controls the potential on the data line so that the voltage between the electrode pair becomes a value sufficient to change to the predetermined voltage while the data line driving means applies the data voltage to the data line.

Furthermore, the potential control means may control the potential on the data line so that, for example, the potential on the data line becomes the average value of the data voltage applied by the data line driving means or the minimum absolute value of the data voltage.

Furthermore, the present invention is the above driving device, wherein the data line driving means applies to parts of data lines a voltage with a polarity different from that to the remaining data lines, and the potential control means controls the potential on the data lines by electrically connecting the data lines applied with voltages with different polarities as the data voltage.

When data voltages with different polarities are applied to a pair of data lines, they have potentials with polarities different each other. Here, if both data lines are electrically connected, a current flows to equalize the potential on both data lines (charges being moved) so that the potential on both data lines can be equalized without consuming electric power. Therefore, in a case where data voltage is applied to each of a number of data lines in such a manner that the polarity of data voltage being applied is reversed every time, the potential on the data line can be made close to the data voltage applied next time without consuming electric power by electrically connecting the data lines to which voltages with polarities different each other is applied as the data voltage so that the power consumption can be reduced.

In driving the liquid crystal display, it is typical to reverse the polarity of voltage applied to each display cell of the liquid crystal display every time. Thus, in a case where parts of the data lines are applied with a voltage with polarity different from that for remaining data lines as the data voltage, and the polarities of data voltages applied to the parts of data lines and the remaining data lines are changed in such a manner that the polarity of voltage applied to each display cell is reversed every time, if the data lines applied with voltages with polarity different each other as the data voltage are electrically connected as described above while a voltage is being applied to a gate line connected to a display cell in which the voltage between the electrode pair is changed by a data voltage being applied to the data line next time, then current is caused to flow to equalize the voltage between the electrode pair of each display cell so that the voltage between the electrode pair of each display cell can be of a value close to the data voltage applied next time without consuming electrical power. Therefore, the power consumption can be further reduced.

In addition, the potential control means may control each of a number of data lines during the time from when the data line driving means applies the data voltage to the data line previous time to when it applies the data voltage next time.

Furthermore, the present invention is the above driving device, wherein the potential control means controls the potential on the data line during the time when a voltage is being applied to the gate line connected to a display cell in which the voltage between the electrode pair is changed by the data voltage applied to the data line next time.

The control of potential on the data line according to the present invention may be performed while a voltage is not being applied to any gate line. However, as described above, if the potential on the data line is controlled while a voltage is being applied to the gate line connected to a display cell in which the voltage between the electrode pair is changed by the data voltage applied to the data line next time, the voltage between the electrode pair of the display cell connected to the gate line also approaches to the data voltage applied next time as the potential on the data line is controlled so that it is possible to further shorten the time from starting of application of the data voltage to when the voltage between the electrode pair changes to a value corresponding to that of gradation to be displayed on the display cell. Thus, the duration of data voltage application can be further shortened.

Furthermore, according to the present invention, the potential control means may comprise potential changing means for changing the potential on the data line, a number of switching means provided between the potential changing means and a number of the data lines, and ON/OFF control means for controlling turning on/off of a number of the switching means.

Furthermore, a method for driving a liquid crystal display according to the present invention is a driving method for driving a liquid crystal display in which a number of data lines and a number of gate lines are arranged to intersect with each other, and respective display cells are positioned at the intersections of the data and gate lines, the display cell consisting of a switching element connected to a data line and a gate line, a pair of electrodes oppositely positioned with a predetermined spacing, and liquid crystal disposed between the pair of electrodes, the driving method comprising steps of applying a voltage to the gate lines to turn on for a predetermined duration the switching element of the display cell connected to the gate line, applying a data voltage to the data line within the predetermined duration to change a voltage between the electrode pair of the display cell to a predetermined voltage, and controlling the potential on the data line so as to close to the data voltage being applied prior to the data voltage application step, whereby the control step allows to shorten the time from when the data voltage is applied to when the voltage between the electrode pair of the display cell reaches the predetermined voltage.

Thus, as in the above, even when the duration is short in applying the data voltage to each data line, because the voltage between the electrode pair of the display cell reaches a predetermined voltage corresponding to the magnitude of the applied data voltage allowing the light transmission of the liquid crystal of each display cell to match the light transmission corresponding to the value of gradation to be displayed on each display cell. Thus, an image can be displayed at high quality even if the duration of application of data voltage is short.

In addition, the present invention is the above driving method, wherein a number of the data lines consists of a plurality of data line groups, and the data voltage application step sequentially applies the data voltage by the data line group within the predetermined duration for each data line group.

As described above, since, according to the present invention, an image can be displayed at high quality even if the duration of data voltage application is short, the image can be displayed at high quality even when the multiplex ratio is increased, that is, even when the number of data lines constituting each data line group is reduced, and the number of data line groups is increased (this shortens the duration of data voltage application). In addition, since the number of data lines constituting each data line group can be reduced, it is easily attained to increase the size and definition of a liquid crystal display.

More particularly, the control step may control the potential on the data line so that the voltage between the electrode pair becomes a value sufficient to change to the predetermined voltage while the data voltage is applied in the data voltage application step.

Furthermore, the control step may control the potential on the data line so that, for example, the potential on the data line becomes the average value or the minimum absolute value or the data voltage.

Furthermore, the present invention is the above driving method, wherein the data voltage application step applies to parts of data lines a voltage with polarity different from that on the remaining data lines, and the control step controls the potential on the data line by electrically connecting the data lines applied with voltages with polarities different each other as the data voltage. Thus, as in the above, the potential on the data line can be made close to the data voltage applied next time without consuming electric power so that the power consumption can be reduced.

Furthermore, the control step may be performed during the time from the application of data voltage to the data voltage previous time to the next application.

Furthermore, the present invention is the above driving method, wherein the control step is performed while a voltage is being applied to the gate line connected to a display cell in which the voltage between the electrode pair is changed by the data voltage applied to the data line next time. Thus, it is possible to further shorten the time from starting of application of the data voltage to when the voltage between the electrode pair of the display cell changes to a value corresponding to that of gradation to be displayed on the display cell so that the duration of data voltage application can be further shortened.

Now, embodiments of the present invention will be explained in detail by referring to the drawings. Although the present invention is explained by using values not affecting thereto, it is not limited to such values indicated in the following.

BRIEF DESCRIPTION OF THE DRAWINGS

FIG. 3 shows timing charts in which

FIG. 4 shows conceptional diagrams in which FIGS. 4(A) to 4(D) show variations of changing-over of polarity of data voltage applied to respective display cells of the LCD;

FIG. 8 shows conceptional diagrams in which

FIG. 10 shows timing charts in which

DESCRIPTION OF THE PREFERRED EMBODIMENTS

First Embodiment

Figure 1:
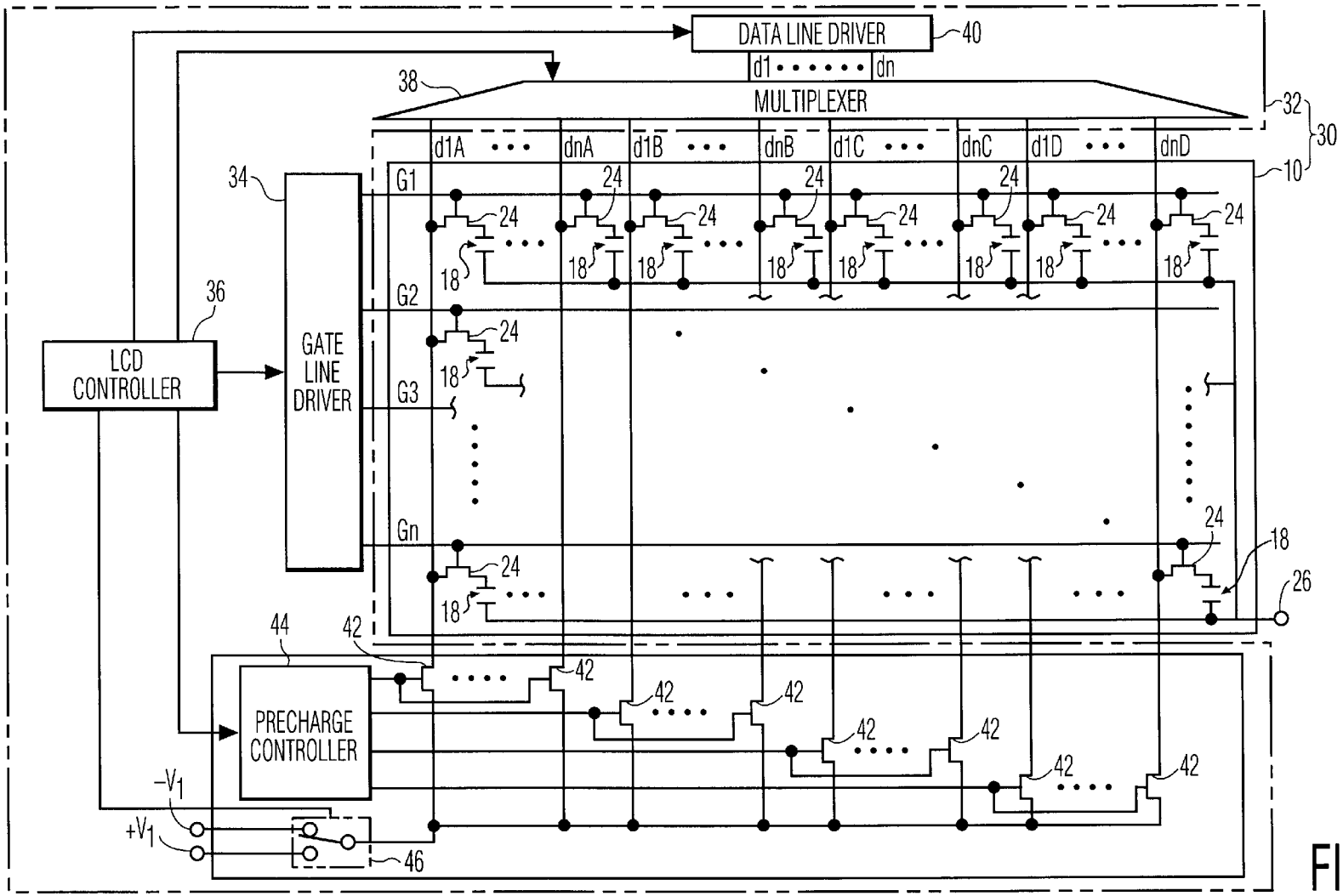
FIG. 1 is a schematic diagram of the arrangement of an LCD unit according to the first embodiment.

FIG. 1 shows a liquid crystal display unit (LCD unit) 30 according to this embodiment. The LCD unit 30 comprises a driving device 32 as the driver for the liquid crystal display according to the present invention, and a reflective type liquid crystal display (LCD) 10 as the liquid crystal display.

Figure 2:
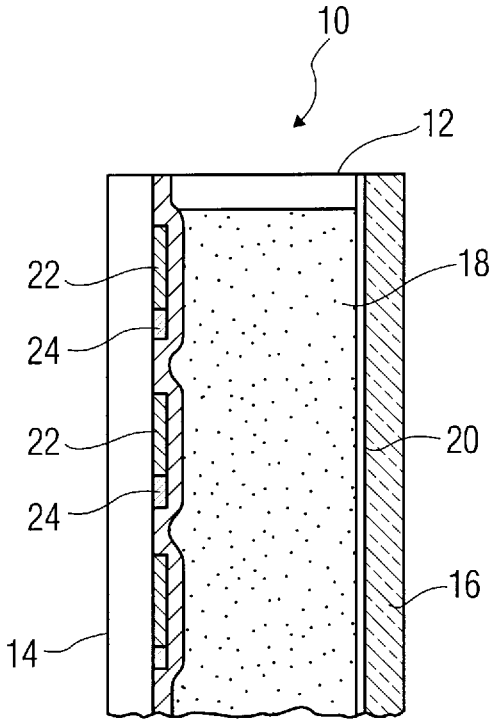
FIG. 2 is a sectional view of an LCD.

As shown in FIG. 2, the LCD 10 comprises a pair of substrates 14 and 16 (the substrate 16 being transparent) oppositely disposed with a predetermined spacing by the spacer 12, between which liquid crystal 18 is sealed. A transparent electrode 20 is formed on the entire surface of the side of substrate 16 contacting the liquid crystal 18. Formed on the surface of substrate 14 contacting the liquid crystal 18 is a crystalline silicone layer on which a number of thin film transistors (TFTs) 24 are formed in a matrix (see FIG. 2). An electrode 22 is provided in correspondence to each of TFTs 24.

FIG. 1 shows the circuit for LCD 10 in a simplified form. While illustration is omitted, the electrodes 22 are connected to the source of respective TFTs 24, and the liquid crystal 18 is held between the electrode 22 and the transparent electrode 20. In FIG. 2, the liquid crystal 18, the electrode 22, and the transparent electrode 20 for a single picture element are schematically shown by using the symbol for capacitor and with the reference "18" for the liquid crystal. The liquid crystal 18 corresponding to a single picture element constitutes a display cell of the present invention together with the electrode 22, the transparent electrode 20, and the TFT 24. The transparent electrode 20 is connected to a common terminal 26. In the embodiment, the common terminal 26 is grounded to make the potential of transparent electrode 20 constant (ground potential).

The LCD 10 has m gate lines G1–Gm extending along a predetermined direction toward the substrate 14. A gate of respective TFTs 24 is connected to any one of the gate lines G1–Gm. Each of gate lines G1–Gm is connected to a gate line driver 34 as gate line driving means, which is then connected to an LCD controller 36.

Provided on the side of substrate 14 of the LCD 10 are 4×n data lines D1A–dnA, d1B–dnB, d1C–dnC, and d1D–dnD extending in a direction intersecting the gate lines G1–Gm. A drain of respective TFTs 24 is connected to any one of the data lines. The data lines are grouped into four data line groups d1A–dnA (data line group A), d1B–dnB (data line group B), d1C–dnC (data line group C), and d1D–dnD (data line group D) each of which consists of n data lines. One end of each data line is connected to a multiplexer 38 having output terminals in the same number as total number of data lines (4×n). The multiplexer 38 has n input terminals each of which is connected to a data line driver 40 through respective signal lines d1–dn. The data line driver 40 and the multiplexer 38 correspond to the data line driving means of the present invention. The data line driver 40 and the multiplexer 38 are connected to the LCD controller 36.

The other end of each data line is connected to the source of respective transistors 42. In the following, to distinguish respective transistors, n transistors connected to the data line group A d1A–dnA are called a "transistor group 42A," n transistors connected to the data line group B d1B–dnB are called a "transistor group 42B," n transistors connected to the data line group C d1C–dnC are called a "transistor group 42C," and n transistors connected to the data line group D d1D–dnD are called a "transistor group 42D." The gate of each transistor in the transistor groups 42A, 42B, 42C, and 42D is connected to a precharge controller 44 which is connected to the LCD controller 36. Each transistor 42 corresponds to the switching means of the present invention, and the precharge controller 44 corresponds to the ON/OFF control means of the present invention.

In addition, the drain of each transistor in the transistor groups 42A, 42B, 42C, and 42D is connected to a voltage switching circuit 46. The voltage switching circuit 46 is connected to the LCD controller 36, and supplied with precharge voltages $+V_1$ and $-V_1$. The voltage switching circuit 46 applies the precharge voltages $+V_1$ and $-V_1$ to the drain of the transistor according to an instruction from the LCD controller 36. The transistor groups 42A, 42B, 42C, the precharge controller 44, the voltage switching circuit 46, and the LCD controller 36 correspond to the potential control means of the present invention. The voltage switching circuit 46 corresponds to the potential changing means of the present invention.

The precharge voltage $+V_1$ may be a value of one-half of the maximum value of data voltage which is described later, and the precharge voltage $-V_1$ may be a value of one-half of the minimum value of data voltage. As an example, if the maximum value of data voltage is +2.5 V, and the minimum value is −2.5 V, the precharge voltage $+V_1$=+1.25 V, $-V_1$= −1.25 V (that is, average values of applied data voltage). Although the voltage switching circuit 46 is schematically shown as a switch in FIG. 1, it actually includes a switching element such as a transistor.

Now, the operation of the first embodiment is explained. When an image is displayed on the LCD 10, the LCD controller 36 controls the operation of the gate line driver 34 in such a manner that any one of m gate lines G1–Gm is applied for a predetermined duration with a gate voltage turning on the TFT 24 connected to that gate line, and the gate lines applied with the gate voltage are sequentially changed over by the predetermined duration. The LCD controller 36 sequentially outputs image data representing gradation values to be displayed on each display cell in a display cell array connected to the gate line applied with the gate voltage to the data line driver 40 in synchronization with the timing in which the gate line driver 34 changes over the gate lines applied with the gate voltage.

The data line driver 40 sequentially takes out image data for n display cells connected to a predetermined data line group from the input image data representing the gradation value to be displayed on each display cell, outputs voltage with magnitude corresponding to the gradation value represented by the taken-out image data (data voltage) to the multiplexer 38 through the signal lines d1–dn, and repeats these operations. Thus, the data line driver 40 outputs the data voltage to be applied to the display cells connected to each data line group to the multiplexer 38 in an order from the data line group A. The multiplexer 38 applies the data voltage output from the data line driver 40 to respective data lines of the corresponding data line group.

Figure 3A:
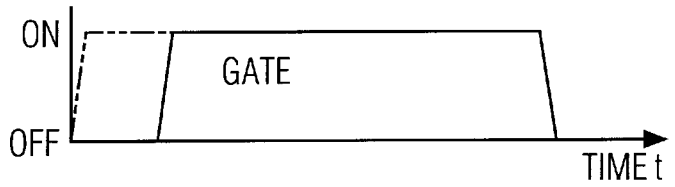
FIG. 3(A) and FIG. 3(B) show changes of gate voltage and data voltage.
Figure 3B:
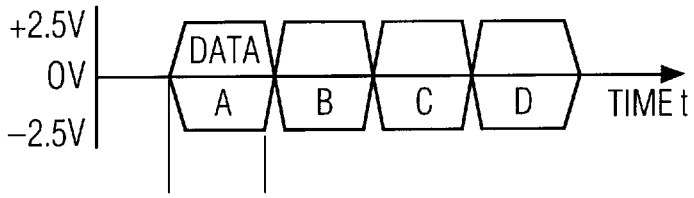

Thus, also as shown in FIG. 3(B), the data voltage is applied to the data line groups A–D in this order within the duration when the gate voltage is applied to a predetermined gate line. The data voltage is then applied between an electrode pair consisting of the electrode 22 and the transparent electrode 20 of respective display cells for which TFT 24 is turned on. As described, the driving device 32 according to this embodiment performs multiplex driving with multiplex ratio n=4 for the LCD 10.

As for the polarity of data voltage, it may be acceptable to, as shown in FIG. 4(A), apply a data voltage with the same polarity to all display cells of the LCD when displaying the image of a frame, and to reverse the polarity of data voltage every one frame, or to, as shown in FIG. 4(B), apply a data voltage with the same polarity to an array of display cells connected to a same gate line when displaying the image of a frame, to reverse the polarity of data voltage every gate line, and, for the next frame, to apply a data voltage with polarity different from that of data voltage applied the previous time to each display cell array.

In addition, the LCD controller 36 changes over the voltage switching circuit 46 in such a manner that, if the polarity of data voltage applied to each data line through the data line driver 40 and the multiplexer 38 is positive, the precharge voltage $+V_1$ is applied to the drain of each transistor in the transistor groups 42A–42D, and, if the polarity of data voltage applied to each data line is negative, the precharge voltage $-V_1$ is applied to the drain of each transistor. That is, when the polarity of data voltage is reversed every one image frame as shown in FIG. 4(A), the precharge voltage is also switched every one image frame, and when the polarity of data voltage is reversed every one gate line as shown in FIG. 4(B), the precharge voltage is also switched every one gate line.

Figure 3C:
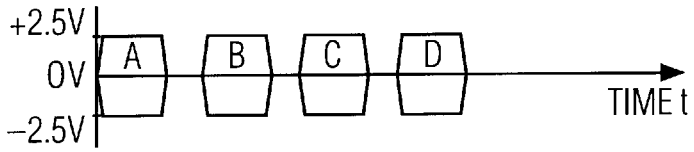
FIG. 3(C) shows an example of application timing of precharge voltage according to the first embodiment.

Furthermore, the LCD controller 36 sequentially turns on the transistor groups 42A–42D connected to the data line groups A–D through the precharge controller 44 at the timing shown in FIG. 3(C).

Thus, a precharge voltage ($+V_1$ or $-V_1$) with the same polarity as that of the data voltage applied next time is applied to a data line before application of data voltage by the data line groups A–D. Therefore, if the data voltage is applied through the data line driver 40 and the multiplexer 38, the potential on each data line is changed to a value substantially equal to the applied precharge voltage, or a value close to the data voltage applied next time (an average value of data voltage being applied if the range of data voltage is +2.5 V−−2.5 V, and the precharge voltage is +1.25 V or −1.25 V).

In addition, when the precharge voltage is applied to the data line groups B–D, also as shown in FIG. 3(A), because the gate voltage is applied to the gate line, and the TFT 24 of each display cell in the display cell array connected to the gate line is turned on, the precharge voltage is applied between the electrode pair for the display cell in the display cell array connected to any one of respective data lines in the data line groups B–D, and the voltage between the electrode pair of the display cell substantially matches the precharge voltage when the data voltage is applied.

Figure 3D:
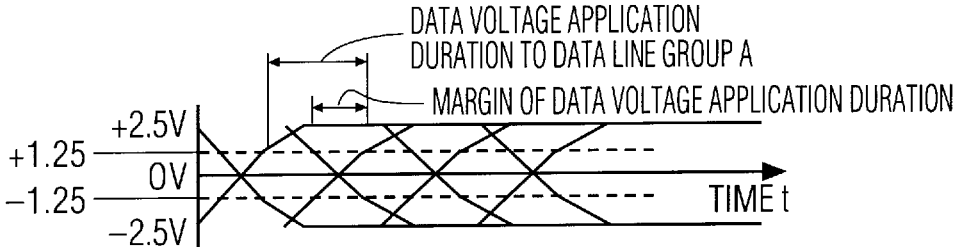
FIG. 3(D) shows changes of voltage between the electrode pair of a display cell in the first embodiment.
Figure 10A:
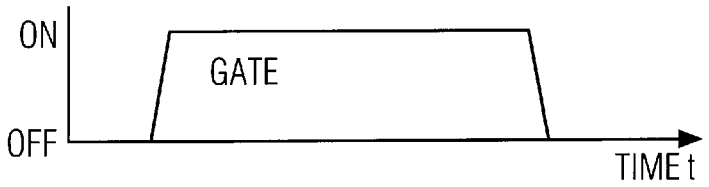
FIG. 10(A) shows changes of gate voltage.
Figure 10B:
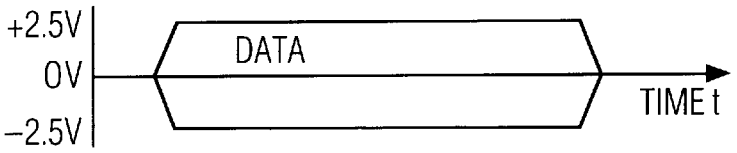
FIGS. 10(B) and 10(C) show changes of data voltage and voltage between the electrode pair when multiplex driving is not performed.
Figure 10C:
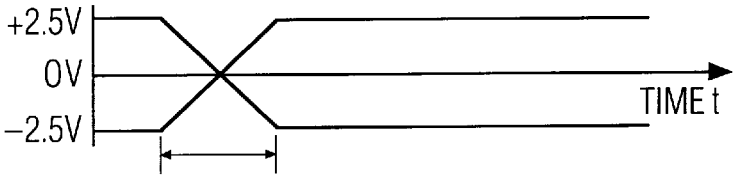
Figure 10D:
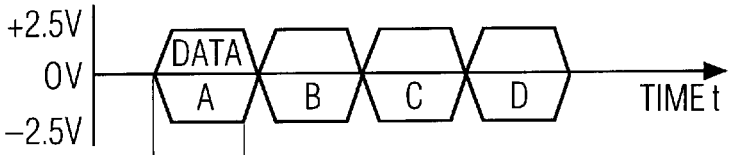
FIGS. 10(D) and 10(E) show changes of data voltage and voltage between the electrode pair when multiplex driving is performed.
Figure 10E:
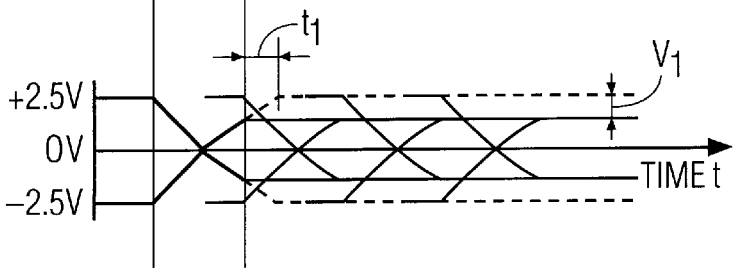

Therefore, when it is started to apply the data voltage for each data line group, also as shown in FIG. 3(D), the voltage between the electrode pair of a display cell in which the TFT 24 is turned on reaches a value corresponding to the data voltage applied before the data voltage application duration completes when compared with a case where no precharge is performed (see FIG. 10(E)). Because the light transmittance of the liquid crystal 18 disposed between the electrode pair varies in accordance with the voltage between the electrode pair, the above causes the light transmittance of the liquid crystal 18 to match that corresponding to the value of gradation to be displayed on the display cell. This enables it to display an image at high quality even when the multiplex ratio is high and the duration of application of the data voltage is short for each display cell.

While, in the above, the transistors in the transistor group A are turned on when the gate voltage is not applied to the gate line, it is not limited to such approach. As shown in FIG. 3(A) with imaginary lines, it is allowed that the gate voltage is applied to the gate line even when each transistor in the transistor group 42A is turned on by advancing the timing to start application of the gate voltage to the gate line. Then, because, also for each display cell connected to the data line groups A d1A–dnA connected to the transistor group 42A, the voltage between the electrode pair would be caused to be substantially equal to the precharge voltage when the data voltage is applied, the time is more reduced from the time when it is started to apply the data voltage to the time when the voltage between the electrode pair matches the data voltage, which is preferable.

In addition, for the above approach, when the data voltage with positive polarity is applied, each data line and the voltage between the electrode pair of each display cell applied with the data voltage are $+V_1$, and when the data voltage with negative polarity is applied, the potential on the data line is $-V_1$ so that it becomes possible to reduce the amplitude of data voltage to be driven by the data line driver 40 (if it is assumed that the maximum value of the data voltage is +2.5 V, the minimum value is −2.5 V, and the precharge voltage $V_1$ is ±1.25 V, the amplitude can be made +2.5 V−1.25 V to −2.5 V+1.25 V, or +1.25 V to −1.25V).

Furthermore, although, in the above, the transistors in each of the transistor groups 42A–42D are turned on at different timing with each other, it is not limited to such approach. For example, at the timing for turning on the transistor group 42A as shown in FIG. 3(C), all transistors in the transistor groups 42A–42D may be turned on. Also, as described in the above, it is needless to say that the gate voltage is preferably applied to the gate line as shown in FIG. 3(A) with imaginary lines.

Second Embodiment

Figure 5:
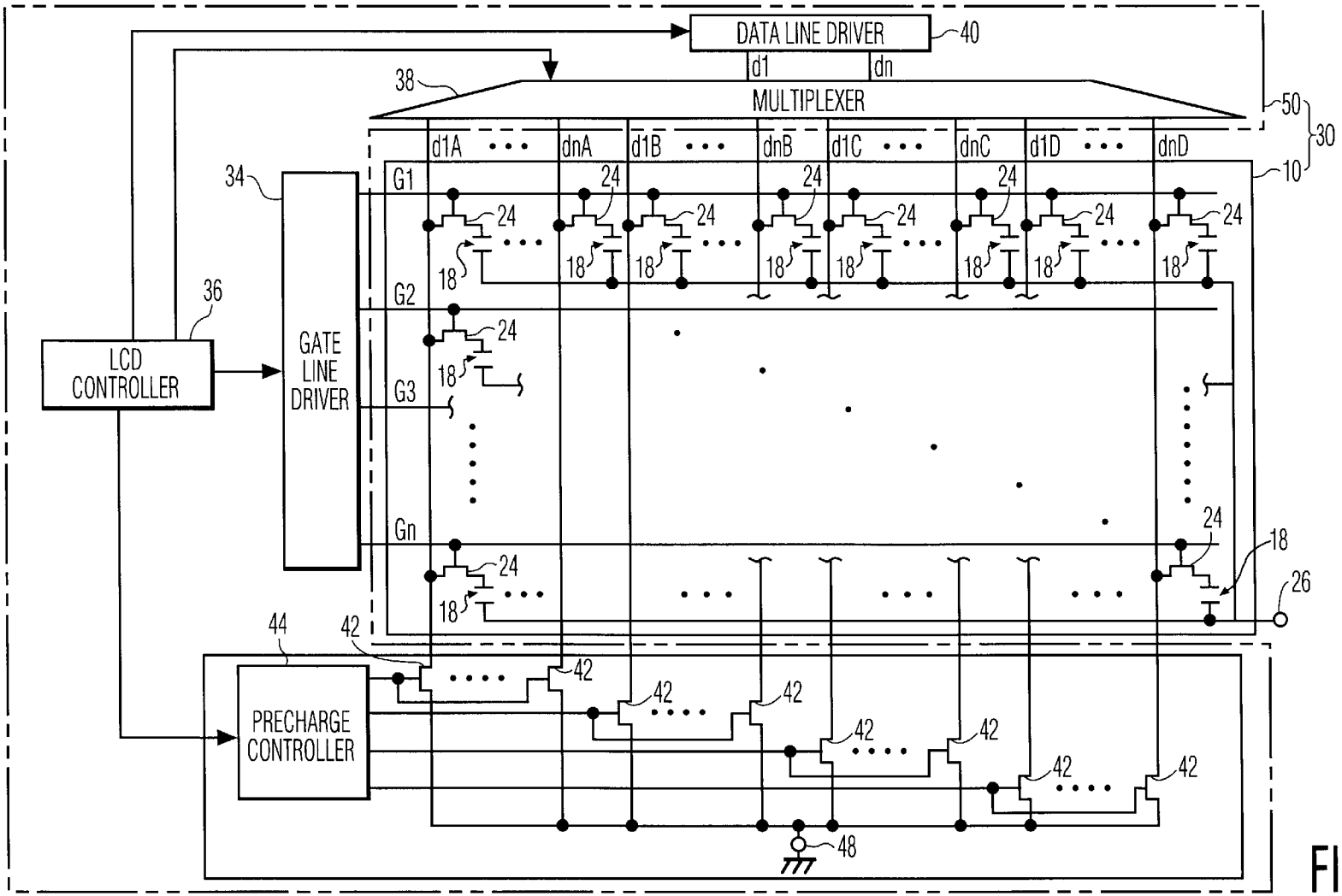
FIG. 5 is a schematic arrangement of an LCD unit according to the second embodiment.

Next, the second embodiment of the present invention is explained. Components same as or similar to those of the first embodiment are attached with the same reference numerals and their description is omitted. As shown in FIG. 5, the voltage switching circuit 46 is omitted from the driving device 50 according to the second embodiment. The drain of each of transistors in the transistor groups 42A, 42B, 42C, and 42D is grounded through the terminal 48. In the second embodiment, wiring connecting the drain of each transistor and the grounding terminal corresponds to the potential control means of the present invention.

Next, the operation of the second embodiment is explained. In the second embodiment, the data line driver 40 changes over the polarity of data voltage as shown in FIG. 4(B) to display an image on the LCD 10. The precharge controller 44 sequentially turns on the transistor groups 42A–42D connected to the data line groups A–D in this order in the timing shown in FIG. 3(C). When the polarity of data voltage is changed over as shown in FIG. 4(B), the polarity of data voltage applied on respective data line is reversed every time. However, when each transistor in the transistor groups 42A–42D is turned on, the data line connected to at least the turned on transistor has the potential of zero volt (ground potential). Accordingly, the potential on each data line when the data voltage is applied would be a value close to the data voltage being applied (more particularly, the maximum absolute value of the data voltage to be applied).

For the data line groups B–D, because the gate voltage is applied to the gate line when each transistor in the transistor groups 42B–42D, and the TFT 24 of each display cell in the display cell array connected to the gate line is turned on, the voltage between the electrode pair is also made zero volt for the display cell connected to any data line of the data line groups B–D of the display cell array. Since the polarity of data voltage applied to respective display cell is reversed every time, the voltage between the electrode pair of each display cell connected to the data line groups B–D is changed to a value close to the data value being applied when the data voltage is applied through the data line driver 40 and the multiplexer 38.

Figure 3E:
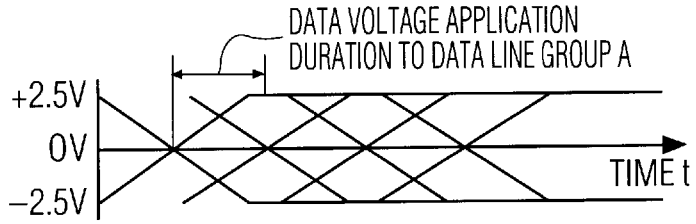
FIG. 3(E) shows changes of voltage between the electrode pair of a display cell in the second embodiment.

Therefore, when it is started to apply the data voltage to each data line group, also as shown in FIG. 3(E), the voltage between the electrode pair of the display cell reaches a value corresponding to the data voltage prior to expiration of data voltage application duration earlier than the conventional arrangement (FIG. 10(E)). The light transmittance of the liquid crystal 18 of the display cell also matches the light transmittance corresponding to the gradation value to be displayed on the display cell. Thus, an image can be displayed at high quality even when the multiplex ratio is high and the duration of application of the data voltage is short for each display cell.

Also in the second embodiment, at the timing for turning on the transistor group 42A as shown in FIG. 3(C), all transistors in the transistor groups 42A–42D may be turned on. Also, the gate voltage is preferably applied to the gate line as shown in FIG. 3(A) with imaginary lines.

In addition, when the polarity of data voltage is changed over by one frame of image as shown in FIG. 4(A) to display an image on the LCD 10, because the data voltage with the same polarity is applied to each data line while one frame of the image is displayed, the potential on each data line when the data voltage is applied has the same polarity as that of the data voltage being applied, except for the time when the data voltage is applied to the top display cell array connected to the gate line G1. Thus, it is not preferable to turn on the transistor when the gate voltage is not applied to any of the gate lines G1–Gm as in the transistor group A to change only the potential on the data line.

Therefore, when an image is displayed on the LCD 10 by changing over the polarity of data voltage every one image frame, it is sufficient to turn on each transistor in the transistor groups 42A–42D while the gate voltage is being applied to the gate line by advancing the timing to start application of the gate voltage to the gate line (sequentially turning on each transistor in the transistor groups 42A–42D at the timing shown in FIG. 3(C), or turning on all transistors in the transistor groups 42A–42D at the timing shown in FIG. 3(C) when the transistor group 42A is turned on). Thus, when the data voltage is applied to each display cell, the voltage between the electrode pair of each display cell would be changed to 0V, that is, a value close to the data voltage being applied.

Although the terminal 48 is grounded in the above, instead the terminal 48 may be applied with a constant voltage. For example, when the maximum absolute value of data voltage depends on the polarity of data voltage, it is possible to apply to the terminal 48 a voltage corresponding to the average value of the maximum value of data voltage when the polarity is positive and the maximum value of data voltage when the polarity is negative (minimum value of data voltage). Thus, even when the maximum absolute value of data voltage depends on the polarity of data voltage, the time from starting the data voltage application to the data line until the voltage between the electrode pair of the display cell reaches a value corresponding to the value of gradation to be displayed on the display cell can be made constant regardless of the polarity of data voltage being applied.

Third Embodiment

Figure 6:
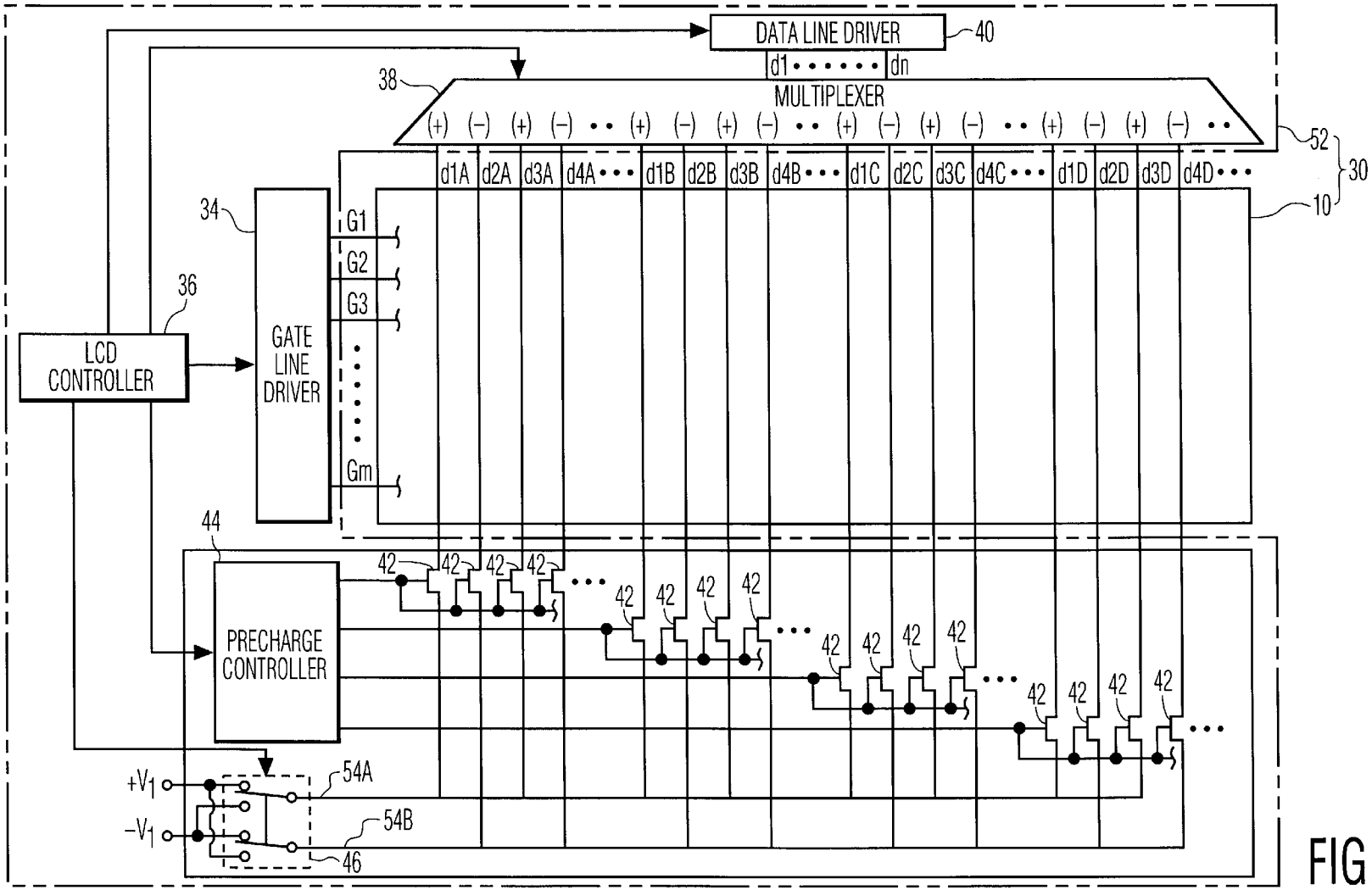
FIG. 6 is a schematic arrangement of an LCD unit according to the third embodiment.

Now, the third embodiment of the present invention is explained. Components same as or similar to those of the first embodiment are attached with the same reference numerals and their description is omitted. As shown in FIG. 6, in the driving device 52 according to the third embodiment, the drains of transistors in the transistor groups 42A, 42B, 42C, and 42D the sources of which are connected to the respective odd-numbered data lines in the data line groups A, B, C, and D (that is, data lines d1A, d3A, . . . d1B, d3B, . . . d1C, d3C, . . . d1D, d3D, . . . ) are connected to a power supply line 54A, while the drains of transistors the sources of which are connected to the respective even-numbered data lines in the data line groups A, B, C, and D (that is, d2A, d4A, . . . d2B, d4B, . . . d2C, d4C, . . . d2D, d4D, . . . ) are connected to the power supply line 54B.

The power supply lines 54A and 54B are connected to the voltage switching circuit 46. The voltage switching circuit 46 applies the precharge voltage $+V_1$ or $-V_1$ to the power supply lines 54A and 54B according to an instruction from the LCD controller 36. However, the polarities of the precharge voltage the voltage switching circuit 46 applies to the power supply lines 54A and 54B are different each other. Then, when the precharge voltage $+V_1$ is applied to the power supply line 54A, the precharge voltage $-V_1$ is applied to the power supply line 54B, and when the precharge voltage $-V_1$ is applied to the power supply line 54A, the precharge voltage $+V_1$ is applied to the power supply line 54B. In the third embodiment, the power supply lines 54A and 54B, and the voltage switching circuit 46 correspond to the potential changing means of the present invention.

Next, the operation of the third embodiment is explained. The data line driver 40 according to the third embodiment applies the data voltage with polarity different each other to the odd-numbered data lines and the even-numbered data lines in the data line groups A, B, C, and D (see FIGS. 4(C) or (D)). The polarity of the data voltage applied to each data line may be reversed every one gate line as shown in FIG. 4(C), or reversed every one image frame as shown in FIG. 4(D).

In addition, the LCD controller 36 changes over the voltage switching circuit 46 in such a manner that, if the polarity of the data voltage applied to the odd-numbered data lines in the data line groups A, B, C, and D through the data line driver 40 and the multiplexer 38 is positive (that is, the polarity of the data voltage applied to the even-numbered data lines is negative), the precharge voltage $+V_1$ is applied to the power supply line 54A and the precharge voltage $-V_1$ is applied to the power supply line 54B, and that, if the polarity of the data voltage applied to the odd-numbered data lines is negative (that is, the polarity of the data voltage applied to the even-numbered data lines is positive), the precharge voltage $-V_1$ is applied to the power supply line 54A and the precharge voltage $+V_1$ is applied to the power supply line 54B.

That is, when the polarity of the data voltage applied to each data line is reversed every one gate line as shown in FIG. 4(C), the operation of the voltage switching circuit 46 is controlled in such a manner that the polarity of the precharge voltage applied to the power supply lines 54A and 54B is also changed over every one gate line. When the polarity of the data voltage applied to each data line is reversed every one image frame as shown in FIG. 4(B), the operation of the voltage switching circuit 46 is controlled in such a manner that the polarity of the precharge voltage applied to the power supply lines 54A and 54B is also changed over every one image frame. In addition, the LCD controller 36 sequentially turns on the transistor groups 42A–42D connected to the data line groups A–D through the precharge controller 44 at the timing shown in FIG. 3(C).

Thus, as in the first embodiment, the precharge voltage with the same polarity as the data voltage applied to each data line next time ($+V_1$ or $-V_1$) is applied to each of the data line groups A–D. The potential on each data line when the data voltage is applied is changed to a value close to the data voltage being applied (for example, when the data voltage ranges +2.5 V–−2.5 V, and the precharge voltage is +1.25 V or −1.25 V, a value close to the average value of the data voltage being applied), the precharge voltage is applied between the electrode pair for a display cell connected to any one of data lines in the data line groups B–D, and, when the data voltage is applied, the voltage between the electrode pair of the display cell becomes a value substantially matching the precharge voltage.

Therefore, when it is started to apply the data voltage to each data line group, also as shown in FIG. 3(D), because the voltage between the electrode pair of a display cell the TFT 24 of which is turned on reaches a value corresponding to the data voltage before the data voltage application duration expires, and the light transmittance of the liquid crystal 18 of the display cell would match that of the value of gradation to be displayed on the display cell. Thus, an image can be displayed at high quality even when the multiplex ratio is high and the duration of application of the data voltage is short for each display cell.

Also in the third embodiment, as shown in FIG. 3(A) with imaginary lines, it may be possible that the gate voltage is applied to the gate line even when each transistor in the transistor group 42A is turned on by advancing the timing to start application of the gate voltage to the gate line. It may be also possible that all transistors in the transistor groups 42A–42D are simultaneously turned on at the timing shown in FIG. 3(C) when the transistor group 42A is turned on. In such case, it is needless to say that the gate voltage is preferably applied to the gate line as shown in FIG. 3(A) with imaginary lines.

Fourth Embodiment

Figure 7:
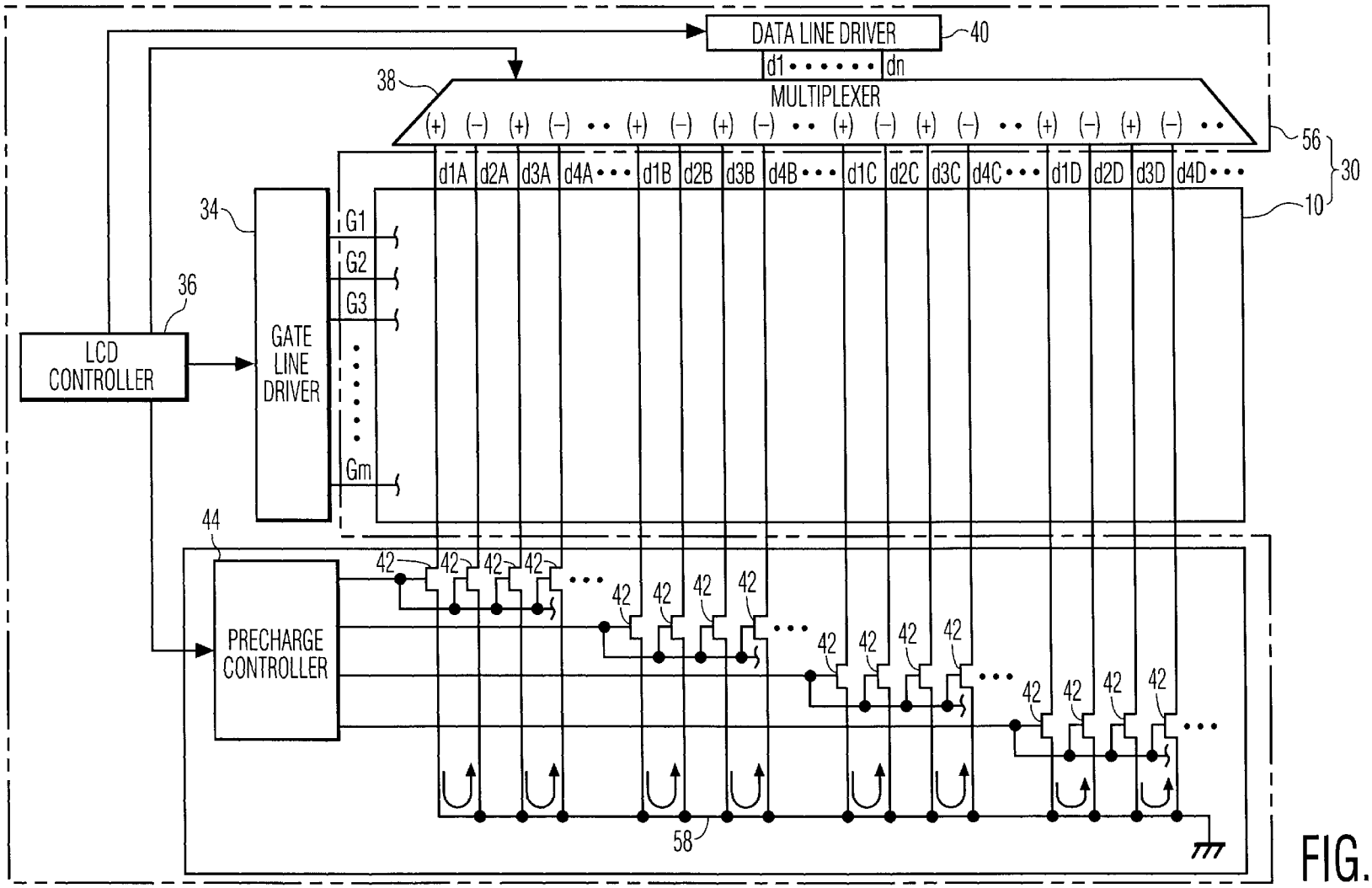
FIG. 7 is a schematic arrangement of an LCD unit according to the fourth embodiment.

Next, the fourth embodiment of the present invention is explained. Components same as or similar to those of the third embodiment are attached with the same reference numerals and their description is omitted. As shown in FIG. 7, the voltage switching circuit 46 is omitted from the driving device 56 according to the fourth embodiment. The drains of transistors in the transistor groups 42A, 42B, 42C, and 42D are grounded through the grounding conductor 58. In the fourth embodiment, the grounding conductor 58 corresponds to the potential changing means of the present invention.

Next, the operation of the fourth embodiment is explained. The data line driver 40 according to the fourth embodiment applies, as in the third embodiment, the data voltage with polarity different each other to the odd-numbered data lines and the even-numbered data lines in the data line groups A, B, C, and D, and reverses the polarity of data voltage applied to each data line by every one gate line (see FIG. 4(C)). In addition, the LCD controller 36 sequentially turns on the transistor groups 42A–42D connected to the data line groups A–D at the timing shown in FIG. 3(C).

Since, in the fourth embodiment, voltages with different polarities are applied to adjacent data lines as the data voltage, the adjacent data lines have potential with polarity different each other. Thus, when each transistor in the transistor groups 42A–42D is turned on, charges move in the direction indicated by an arrow in FIG. 7 or opposite direction through the grounding conductor 58 so as to make the potential on the adjacent data lines equally zero volt. When each transistor in the transistor groups 42A–42D is turned on, because the gate voltage is applied to the gate line, the TFT 24 of each display cell connected to the gate line is turned on, and, for the display cell connected to any one of data lines in the data line groups B–D, charges move through the grounding conductor 58 to make equally zero volt with the voltage between the electrode pair of a pair of display cell connected to the adjacent data lines, respectively, as shown in FIG. 8(B).

Figure 8A:
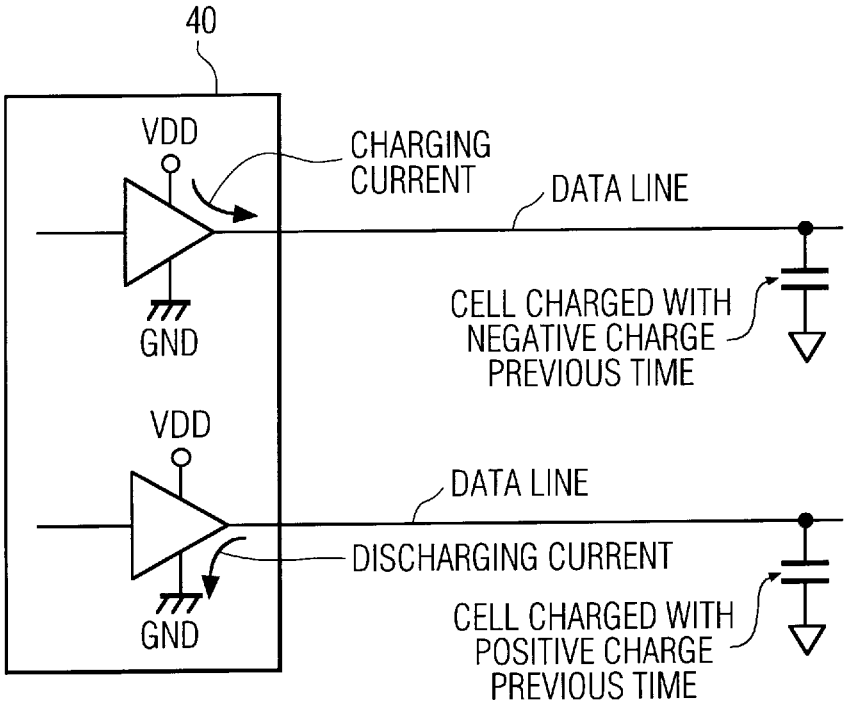
FIG. 8(A) illustrates how electrical power is uselessly consumed as the data voltage is applied by a conventional driving method.
Figure 8B:
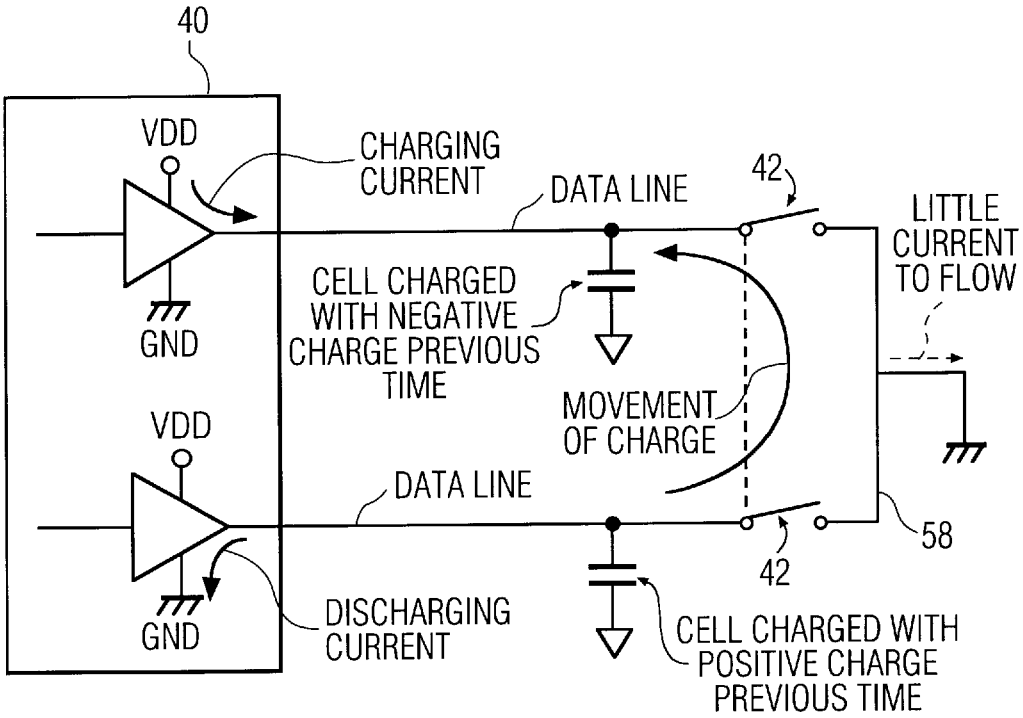
FIG. 8(B) illustrates the operation of the fourth embodiment.

FIG. 8(B) schematically shows the transistor 42 and the data line driver 40, and the multiplexer 38 is omitted for illustration.

It is typical to reverse every time the potential of the data voltage applied to respective display cells of the LCD 10. In the conventional driving method, as schematically shown in FIG. 8(A), the display cell to which the data voltage with positive potential is applied previous time is caused to have the voltage between the electrode pair of zero volt as the charges accumulated between the electrode pair flows as a discharge current to the ground terminal when the data voltage is applied next time so that the voltage between the electrode pair is made zero volt. Further, the potential of the electrode pair becomes negative by applying the data voltage with negative potential. In addition, the display cell to which the data voltage with negative potential is applied previous time has the voltage between the electrode pair of zero volt when the data voltage with positive polarity is applied next time, and a charging current flows until the polarity of the voltage between the electrode pair reaches a predetermined positive value. Therefore, the charges accumulated between the electrode pair of the display cell to which the data voltage is applied (and, charges accumulated in the data lines) are uselessly disposed. This is also true to the first to third embodiment described above.

On the contrary to the above, in the fourth embodiment, by turning on each transistor in the transistor groups 42A–42D, charges move through the grounding conductor 58 so that the potential on the adjacent data lines (for the data line groups B–D, also the voltage between the electrode pair of a pair of display cells connected to the adjacent data lines, respectively) also becomes equal. In this case, if the absolute values of potentials on the adjacent data lines are equal, no charge flows to the grounding terminal so that the potentials on the adjacent data lines can be made zero volt equally without wasting any electrical power. Thus, the electrical power consumed by driving the data line can be reduced by 50%.

However, since each data line is applied with the data voltage with magnitude corresponding to the value of gradation to be displayed on each display cell, the potential on the data line when the transistor is turned on has a value corresponding to the magnitude of data voltage previously applied, the absolute values of potentials on the adjacent data lines are not necessarily equal. If the absolute values of potentials on the adjacent data lines, when the transistor is turned on, charges (current) not contributing change of the potential on the data line (and, the voltage between the electrode pair of the display cell), although it is very small, flows from the grounding conductor 58 to the grounding terminal.

Therefore, although the reduction of power consumption is slightly less than 50%, it is possible to make the potentials on the adjacent data lines (and, the voltage between the electrode pair of a pair of display cells connected to the adjacent data lines, respectively) zero volt equally consuming substantially no electrical power (disposing substantially no accumulated charge) by more effectively utilizing the charges accumulated on the data lines or between the electrode pair of the display cell than in the prior art so that the electrical power consumed by driving the data line can be significantly reduced.

Furthermore, when the data voltage is applied, because the potential on each data line (and, the voltage between the electrode pair of each display cell connected to the data line groups B–D) is zero volt, as in the first to third embodiments, the voltage between the electrode pair of the data cell applied with the data voltage reaches a value corresponding to the data voltage before the data voltage application duration expires, and the light transmittance of the liquid crystal 18 of the display cell matches that of the value of gradation to be displayed on the display cell. Thus, an image can be displayed at high quality even when the multiplex ratio is high and the duration of application of the data voltage is short for each display cell.

Also, in the fourth embodiment, it is preferable that the gate voltage is applied to the gate line at the timing shown in FIG. 3(A) with imaginary lines so that the gate voltage has been applied to the gate line when the transistor group 42A is turned on. Then, the charge accumulated between the electrode pair of the display cell connected to the data line group A can be also effectively utilized when the data voltage is applied next time. All transistors in the transistor groups 42A–42D may be turned on at the timing shown in FIG. 3(C) when the transistor group 42A–42D is turned on. In such case, it is needless to say that the gate voltage is preferably applied to the gate line as shown in FIG. 3(A) with imaginary lines.

In addition, when an image is displayed on the LCD 10 by changing over the polarity of data voltage every one image frame as shown in FIG. 4(D), it is sufficient to turn on each transistor in the transistor groups 42A–42D while the gate voltage is being applied to the gate line by advancing the timing to start application of the gate voltage to the gate line (sequentially turning on each transistor in the transistor groups 42A–42D at the timing shown in FIG. 3(C), or turning on all transistors in the transistor groups 42A–42D at the timing shown in FIG. 3(C) when the transistor group 42A is turned on). Thus, the voltage between the electrode pair of each display cell can be changed to zero volt, or a value close to the data voltage being applied before the data voltage is applied to each display cell so that the power consumption can be reduced, and an image can be displayed at high quality even when the duration of application of the data voltage is short for each display cell.

Experimental Results

Next, explanation is given of the results of experiments (simulations) conducted by the inventors. FIG. 9 shows simulations on changes of voltage between the electrode pair in a case where the precharge voltage is not applied (shown by broken lines in FIG. 9), and where it is charged 1.5 V or −1.5 V (shown by solid lines in FIG. 9) when +3 V and −3 V which are the maximum and minimum values as the data voltage, respectively, are alternately applied to the driving device 32 described for the first embodiment.

Figure 9A:
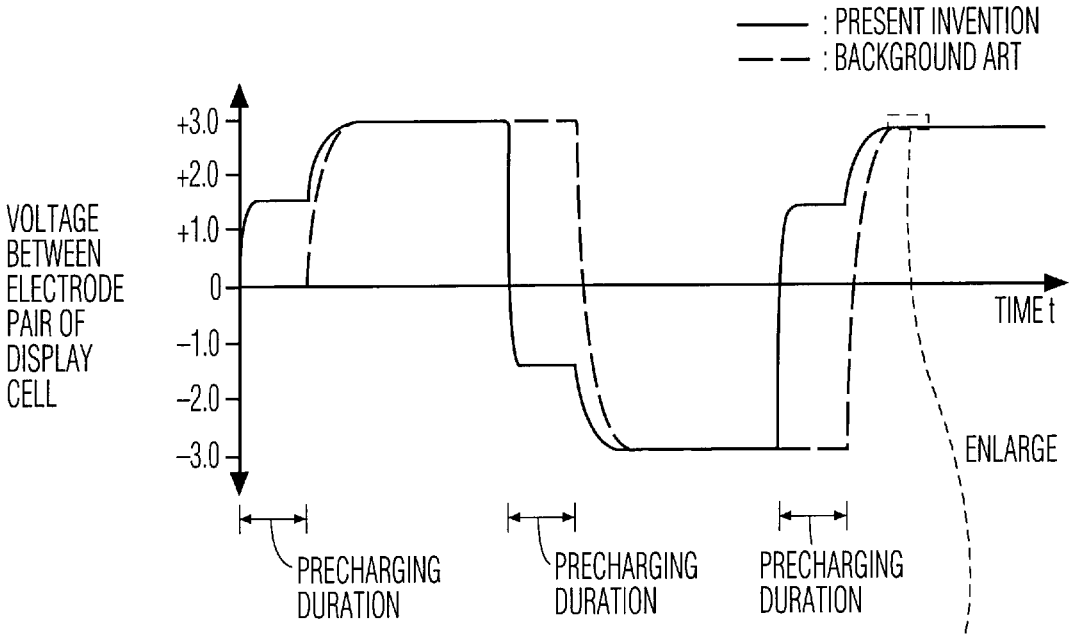
FIGS. 9(A) and 9(B) are diagrams showing the results of simulations conducted by the inventors.
Figure 9B:
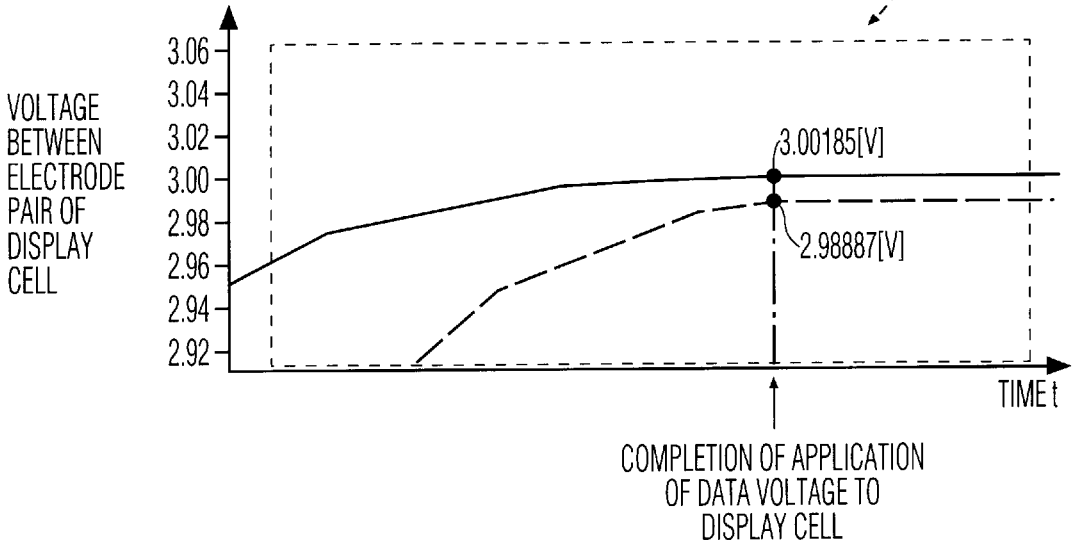

FIG. 9(B) is an enlarged view of the area surrounded by the broken lines in FIG. 9(A). As clearly seen from FIG. 9(B), in a case where the precharging is not performed, the voltage between the electrode pair increases even when the data voltage is completed for application, but does not reach the data voltage (+3 V in this case) with a relatively steep inclination of the increase of the voltage between the electrode pair. The insufficient amount of the voltage between the electrode pair to the data voltage corresponds to the difference of voltage between the electrode pair when the value of gradation differs by "1" in this embodiment although depending on the number of gradations to be displayed on the LCD 10. Thus, it is impossible to match the light transmittance of the liquid crystal of the LCD 10 to that corresponding to the value of gradation represented by the applied data voltage.

On the other hand, in a case where the precharging is performed, as shown by the solid lines in FIG. 9(B), the voltage between the electrode pair reaches the data voltage (+3 V) when the data voltage is completed for application, and the light transmittance of the liquid crystal of the LCD 10 becomes a value exactly corresponding to the value of gradation represented by the data voltage. Therefore, according to the present invention, it is possible to match the light transmittance of the liquid crystal of the LCD 10 to that corresponding to the value of gradation to be displayed on each display cell so that an image can be clearly displayed on the LCD 10 at high quality.

For the third and fourth embodiments, although description is given by exemplifying a case where the data voltages with polarities different each other is applied to the odd-numbered and even-numbered data line groups of the data line groups A, B, C, and D, the present invention is not limited to such arrangement. It is needless to say that the data lines constituting each data line group may be divided into two groups, and data voltages with polarities different each other are applied to respective groups. However, as described for the fourth embodiment, in a case where the potential on the data line (and, the voltage between the electrode pair of display cell) is changed by electrically connecting data lines applied with the data voltages with different polarities, it is preferable to make the number of data lines constituting two groups the same number because the power consumption can be most reduced.

In addition, for the above embodiments, description is given on an example where one end of the data line is connected to the multiplexer 38, and the other end is connected to the transistor 42. The present invention is not limited to such arrangement. It may be possible to connect one end of the data line to the multiplexer 38 and the transistor 42. However, connecting one end of the data line to the multiplexer 38 and the other end to the transistor 42 is preferable because each data line can be inspected for its open or short-circuiting by using the transistor 42 and the multiplexer 38 in the inspection process for the produced LCD.

Furthermore, for the above embodiments, description is given on an example where the gates of the transistors 42 provided in correspondence to respective data lines are grouped into the transistor groups 42A, 42B, 42C, and 42D, and connected to the precharge controller 44. However, when the potential is controlled at the same timing for each data line, it may be possible to bundle and connect the gates of all transistors to the precharge controller 44.

Furthermore, the potential on the data line and the voltage between the electrode pair of the display cell may be precharged to a constant value corresponding to the maximum or minimum value of the data voltage by applying a constant voltage corresponding to the maximum or minimum value of the voltage between the electrode pair of the display cell (for example, +2.5 V or −2.5 V) to the data line while the gate voltage is applied to the gate line. Thus, the data line driver can change the voltage between the electrode pair to a desired polarity and magnitude only by always applying a voltage with a constant polarity to the data line to change the voltage between the electrode pair to a fixed direction (for example, changing the voltage between the electrode pair toward the minimum value when the voltage between the electrode pair is precharged to the maximum value, or changing the voltage between the electrode pair toward the maximum value when the voltage between the electrode pair is precharged to the minimum value) so that it becomes possible to simplify the arrangement of the data line driver.

Recently, it has been attempted to directly incorporate the driving circuit on the panel of LCD. It is a bottleneck that a CMOS structure is relatively difficult to be constructed on the panel of LCD. Contrary to this, when the simplified data line driver as described above is employed, it is possible to streamline the production process, and to attain improvement of yield in the manufacturing stage due to reduction of the number of components constituting the driving circuit so that direct assembly of the driving circuit on the LCD panel can be facilitated.

In addition, while the above description is given by exemplifying a reflective type LCD 10, the present invention is not limited to it, and may be used for a transmission type LCD. In the transmission type LCD, however, because it is impossible to use crystal silicon with very low light transmittance as in the reflective type LCD 10 as the substrate material for forming switching elements such as TFT, a substrate consisting of amorphous silicon or polysilicon is used. However, it is not easy to form logic circuits such as the multiplexer on such substrate of amorphous silicon or polysilicon when compared with the formation on the crystal silicon substrate. Therefore, if it is assumed to perform multiplex driving, it is desirable to apply the present invention to driving of a reflective type LCD.

Furthermore, although the description is given by exemplifying the embodiments performing multiplex driving, the present invention is not limited to it, but may be applied to a conventional driving system where the data voltage is applied to all data line at the same timing.

As described above, as the present invention is arranged to control potential on a number of data lines so that the potential on the data line is close to the data voltage being applied before the data voltage is applied to the data line, it has an excellent advantage that an image can be displayed at high quality even when the duration of application of the data voltage is short for each display cell.

Furthermore, as a number of data lines consist of a plurality of data line groups, and the data voltage is applied to the data line sequentially by the data line group and during the duration where a voltage is applied to the gate line, in addition to the above advantage, the present invention has another advantage that it is easy to increase the area and definition of the liquid crystal display.

Furthermore, as parts of data lines are applied with a voltage with polarity different from that for remaining data lines as the data voltage, and the potential on the data line is controlled by electrically connecting the data lines to which voltages with polarities different each other are applied as the data voltage, in addition to the above advantages, the present invention has still another advantage that the power consumption can be reduced.

Furthermore, as the potential on the data line is controlled while a voltage is applied on the gate line connected to a display cell in which the voltage between the electrode pair is changed by the data voltage applied to the data line next time, in addition to the above advantages, the present invention has yet another advantage that the duration can be shortened for application of the data voltage.

We claim:

1. A driving device for driving a liquid crystal display in which a number of data lines and a number of gate lines are arranged to intersect with each other, and respective display cells are positioned at the intersections of the data and gate lines, each display cell comprising a switching element connected to a data line and a gate line, a pair of electrodes oppositely positioned with a predetermined spacing, and liquid crystal disposed between said pair of electrodes, said driving device comprising:

gate line driving means connected to a number of said gate lines for applying a voltage to said gate lines to turn on for a predetermined duration said switching element of said display cell connected to said gate line;

data line driving means connected to a number of said data lines for applying a data voltage to said data lines for said predetermined duration to change the voltage between the electrode pair of said display cell connected to said gate line to which the voltage is applied by said gate line driving means to a predetermined voltage; and potential control means for controlling potential on a number of said data lines so that, before the data voltage is applied to said data line by said data line driving means, the potential on said data line is close to the data voltage being applied, wherein said data line driving means applies to some of the data lines a voltage with a polarity different from the polarity applied to the remaining data lines, and said potential control means controls the potential on said data lines by electrically connecting the data lines applied with voltages with different polarities as with the data voltage.

2. A driving device for driving a liquid crystal display as claimed in claim 1, wherein a number of said data lines consist of a plurality of data line groups, and the data line driving means sequentially applies a data voltage to the data line in each data line group in the predetermined duration.

3. A driving device for driving a liquid crystal display as claimed in claim 1, wherein said potential control means controls the potential on the data line so that the potential on said data line becomes a value sufficient for the voltage between the electrode pair of said display cell to change to the predetermined voltage while the data line driving means applies the data voltage to the data line.

4. A driving device for driving a liquid crystal display as claimed in claim 3, wherein said potential control means controls the potential on said data line so that the potential on said data line becomes the average value of the data voltage applied by said data line driving means or the minimum absolute value of said data voltage.

5. A driving device for driving a liquid crystal display as claimed in claim 1, wherein said potential control means comprises:

potential changing means for changing the potential on said data line, a number of switching means provided between said potential changing means and a number of said data lines, and ON/OFF control means for controlling turning on/off of a number of said switching means.

6. A driving device for driving a liquid crystal display in which a number of data lines and a number of gate lines are arranged to intersect with each other, and respective display cells are positioned at the intersections of the data and gate lines, each display cell comprising a switching element connected to a data line and a gate line, a pair of electrodes oppositely positioned with a predetermined spacing, and liquid crystal disposed between said pair of electrodes, said driving device comprising:

gate line driving means connected to a number of said gate lines for applying a voltage to said gate lines to turn on for a predetermined duration said switching element of said display cell connected to said gate line;

data line driving means connected to a number of said data lines for applying a data voltage to said data lines for said predetermined duration to change the voltage between the electrode pair of said display cell connected to said gate line to which the voltage is applied by said gate line driving means to a predetermined voltage; and potential control means for controlling potential on a number of said data lines so that, before the data voltage is applied to said data line by said data line driving means, the potential on said data line is close to the data voltage being applied, wherein said potential control means controls each of a number of said data lines during the time from when said data line driving means applies the data voltage to said data line a previous time to when it applies the data voltage a next time.

7. A driving device for driving a liquid crystal display as claimed in claim 6, wherein said potential control means controls the potential on said data line during the time when a voltage is being applied to the gate line connected to a display cell in which the voltage between the electrode pair is changed by the data voltage applied to the data line the next time.

8. A driving method for driving a liquid crystal display in which a number of data lines and a number of gate lines are arranged to intersect with each other, and respective display cells are positioned at the intersections of the data and gate lines, each display cell comprising a switching element connected to a data line and a gate line, a pair of electrodes oppositely positioned with a predetermined spacing, and liquid crystal disposed between said pair of electrodes, said driving method comprising the steps of:

applying a voltage to said gate lines to turn on for a predetermined duration said switching element of said display cell connected to said gate line;

applying a data voltage to said data line within said predetermined duration to change a voltage between the electrode pair of said display cell to a predetermined voltage; and controlling the potential on said data line to close to the data voltage being applied prior to said data voltage application step, wherein said data voltage applying step applies to some of the data lines a voltage with a polarity different from the polarity applied to the remaining data lines, and wherein said controlling step controls the potential on said data line by electrically connecting said data lines applied with voltages with polarities different from each other as with the data voltage, whereby said control step shortens the time from when the data voltage is applied to when the voltage between the electrode pair of said display cell reaches said predetermined voltage.

9. A driving method for driving a liquid crystal display as claimed in claim 8, wherein a number of said data lines consist of a plurality of data line groups, and said data voltage application step sequentially applies the data voltage by the data line group within said predetermined duration for each data line group.

10. A driving method for driving a liquid crystal display as claimed in claim 8, wherein said control step controls the potential on said data line so that the potential on said data line becomes a value sufficient for the voltage between the electrode pair of a display cell to change to the predetermined voltage while the data voltage is applied at the data voltage application step.

11. A driving method for driving a liquid crystal display as claimed in claim 10, wherein said control step controls the potential on said data line so that the potential on said data line becomes the average value of said data voltage or the minimum absolute value of the data voltage.

12. A driving method for driving a liquid crystal display in which a number of data lines and a number of gate lines are arranged to intersect with each other, and respective display cells are positioned at the intersections of the data and gate lines, each display cell comprising a switching element connected to a data line and a gate line, a pair of electrodes oppositely positioned with a predetermined spacing, and liquid crystal disposed between said pair of electrodes, said driving method comprising the steps of:

applying a voltage to said gate lines to turn on for a predetermined duration said switching element of said display cell connected to said gate line;

applying a data voltage to said data line within said predetermined duration to change a voltage between the electrode pair of said display cell to a predetermined voltage; and controlling the potential on said data line to close to the data voltage being applied prior to said data voltage application step, whereby said control step shortens the time from when the data voltage is applied to when the voltage between the electrode pair of said display cell reaches said predetermined voltage, and wherein said controlling step is performed during the time from the application of data voltage to the data line a previous time to the application of data voltage to the data line a next time.

13. A driving method for driving a liquid crystal display as claimed in claim 12, wherein said controlling step is performed while a voltage is being applied to the gate line of a display cell in which the voltage between the electrode pair is changed by the data voltage applied to said data line the next time.

* * * * *